US008063715B2

(12) United States Patent
Sasaki

(10) Patent No.: US 8,063,715 B2
(45) Date of Patent: Nov. 22, 2011

(54) DIRECTIONAL COUPLER

(75) Inventor: Homare Sasaki, Kanagawa-Ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 126 days.

(21) Appl. No.: 12/390,602

(22) Filed: Feb. 23, 2009

(65) Prior Publication Data

US 2009/0231057 A1 Sep. 17, 2009

(30) Foreign Application Priority Data

Mar. 14, 2008 (JP) ..... 2008-066503

(51) Int. Cl.
*H01P 5/18* (2006.01)
*H01P 3/08* (2006.01)

(52) U.S. Cl. ..... 333/116; 333/238

(58) Field of Classification Search ..... 333/109, 333/110, 111, 112, 115, 116, 238
See application file for complete search history.

(56) References Cited

U.S. PATENT DOCUMENTS 3,979,699 A * 9/1976 Caragliano et al. ..... 333/116
5,032,803 A * 7/1991 Koch ..... 333/116
5,745,017 A * 4/1998 Ralph ..... 333/116
6,956,449 B2 * 10/2005 Snyder et al. ..... 333/116

* cited by examiner

*Primary Examiner* — Dean Takaoka
(74) *Attorney, Agent, or Firm* — Oblon, Spivak, McClelland, Maier & Neustadt, L.L.P.

(57) ABSTRACT

A directional coupler which can adjust a degree of coupling easily and by comparatively low cost is provided. A directional coupler has a substrate, a 1st transmission line formed on the substrate, a 2nd transmission line formed on the substrate, and a coupling substrate provided with a 3rd transmission line and a 4th transmission line which form a coupling part. The coupling substrate is attached to the substrate so that the coupling part may be inserted in the 1st transmission line and 2nd transmission line.

14 Claims, 6 Drawing Sheets

| | | PATTERN WIDTH (W) | | |
|---|---|---|---|---|
| | | 0.33mm | 0.46mm | 0.65mm |
| PATTERN GAP (S) | 0.08mm | CHARACTERISTIC (4) | CHARACTERISTIC (2) | |
| | 0.1mm | | CHARACTERISTIC (1) | |
| | 0.12mm | | CHARACTERISTIC (3) | CHARACTERISTIC (5) |

DIRECTIONAL COUPLER

CROSS REFERENCE TO RELATED APPLICATION

This application is based upon and claims the benefit of priority from the prior Japanese Patent Application No. 2008-066503, filed on Mar. 14, 2008, the entire contents of which are incorporated herein by reference.

FIELD OF THE INVENTION

This invention relates to a directional coupler used for a transmission apparatus of a digital wireless communication system and a broadcasting system, for example.

DESCRIPTION OF THE BACKGROUND

In a transmission apparatus of a digital wireless communication system and a broadcasting system, a directional coupler is used for combining process or distributing process of a transmission signal. As broadening a bandwidth of the transmission apparatus is requested in recent years, this directional coupler is strongly desired to have a wideband and good characteristic. For this reason, when the directional coupler is manufactured, a structure of multi-stage coupling is usually used.

In the directional coupler, it may be necessary to change a degree of coupling between each transmission line. In this case, a design change of a circuit pattern is obliged and it may be necessary to exchange the whole substrate which constitutes the directional coupler.

As conventional technology related to this kind, there is a radio frequency filter indicated in JP, PH06-97766A. In this high pass filter, two signal lines are formed on mutually different planes and a substrate is sandwiched between both lines. A degree of coupling is adjusted by choosing thickness of the substrate sandwiched.

An example of a directional coupler which has a multi-stage coupling part considered conventionally is shown in FIG. 12. Directional coupler 300 has coupling parts 302, 304 and 306. Coupling parts 302, 304 and 306 are formed by transmission line 310 formed on one surface of substrate 308 and transmission line 320 formed on another surface. In coupling parts 302 and 306 with shallow degree of coupling, transmission lines 310, 320 are coupled between their edges. In coupling part 304 whose degree of coupling is comparatively deep, transmission line 310 counters transmission line 320 via substrate 308, and transmission line 310 and transmission line 320 are coupled between the surfaces. In this directional coupler, substrate thickness tolerance will influence the degree of coupling greatly depending on the thickness of substrate 308 to be used. And in order to adjust the degree of coupling, it is required to exchange substrate 308 whole. Terminals 330 and 340 are connected with ends of transmission line 320 via through holes 332 and 342.

In the directional coupler according to the conventional technology, when the degree of coupling is changed, it is obliged to exchange the whole substrate with other substrate and a cost increases sharply.

SUMMARY OF THE INVENTION

A purpose of this invention is to provide a directional coupler which can adjust a degree of coupling easily and by comparatively low cost.

According to a directional coupler of an embodiment, the directional coupler has a substrate, a 1st transmission line formed on the substrate, a 2nd transmission line formed on the substrate, and a coupling substrate having a 3rd transmission line and a 4th transmission line which form a coupling part. The coupling substrate is attached to the substrate so that the coupling part may be inserted in the 1st transmission line and 2nd transmission line.

DETAILED DESCRIPTION OF THE INVENTION

Hereinafter, an embodiment of this invention will be explained in detail with reference to drawings.

Figure 1:
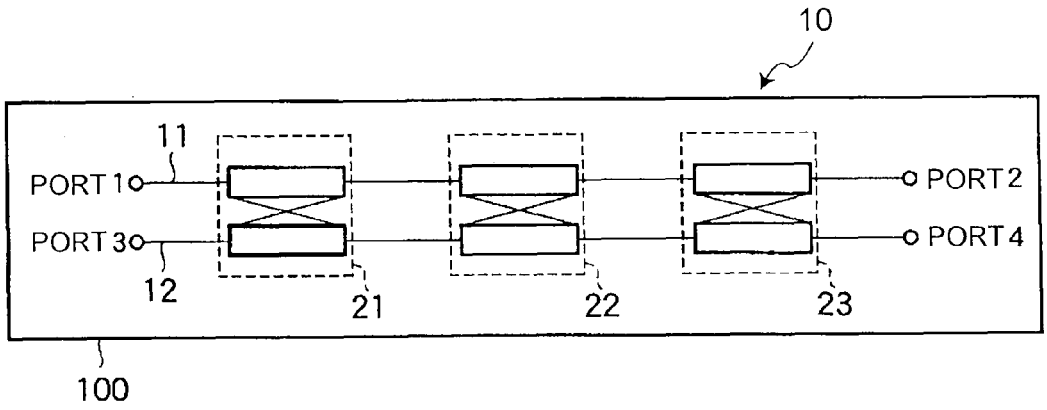
FIG. 1 is a circuit block diagram showing a directional coupler according to one embodiment of the present invention.

FIG. 1 is a circuit block diagram showing the directional coupler according to one embodiment of this invention. In directional coupler 10, transmission lines 11 and 12 are formed in parallel on an upper surface of substrate 100. Port 1 and port 2 for inputting and outputting an RF (radio frequency) signal are connected to both ends of transmission line 11. And port 3 and port 4 for inputting and outputting the RF signal are connected to both ends of transmission line 12.

In order to combine or distribute the RF signal, plural stages, for example, three stages of coupling parts 21, 22 and 23 are formed in these transmission lines 11 and 12.

Figure 2:
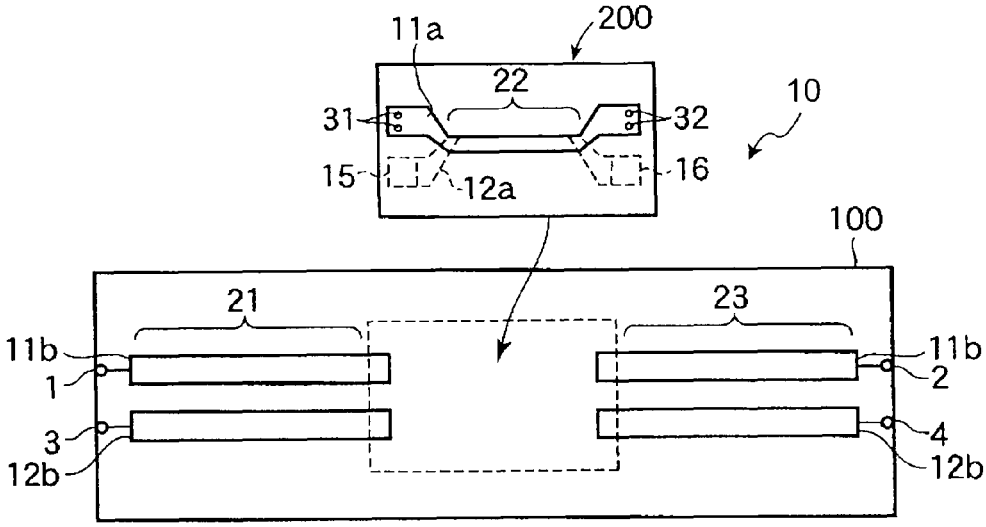
FIG. 2 is a top view of a main portion composition of the directional coupler according to the embodiment.

FIG. 2 shows the directional coupler of this embodiment which realizes directional coupler 10 shown in FIG. 1. In directional coupler 10, coupling parts 21 and 23 are formed on substrate 100, and coupling part 22 is formed in coupling substrate 200 which is different form substrate 100. In order to adjust a degree of coupling of directional coupler 10, coupling substrate 200 in which coupling part 22 having a desired degree of coupling is formed is attached to substrate 100. Coupling part 22 has the deeper degree of coupling compared with coupling parts 21 and 22.

On substrate 100 which consists of dielectric, 1st transmission line 11*b* and 2nd transmission line 12*b* are provided closely and in parallel and form coupling parts 21 and 23. 1st transmission line 11*b* and 2nd transmission line 12B are missing at a portion in which coupling part 22 (coupling substrate 200) is provided. Ports 1, 2, 3 and 4 are connected to each both ends of 1st transmission line 11*b* and 2nd transmission line 12B, respectively. Furthermore, a conductor (not shown) is formed on other principal surface of substrate 100.

Coupling part 22 is formed in coupling substrate 200. In coupling substrate 200, 3rd transmission line 11*a* and 4th transmission line 12*a* are formed on both surfaces of a base substance layer, respectively. 3rd transmission line 11*a* and 4th transmission line 12*a* overlap and counter each other in the central part and form coupling part 22.

Figure 3:
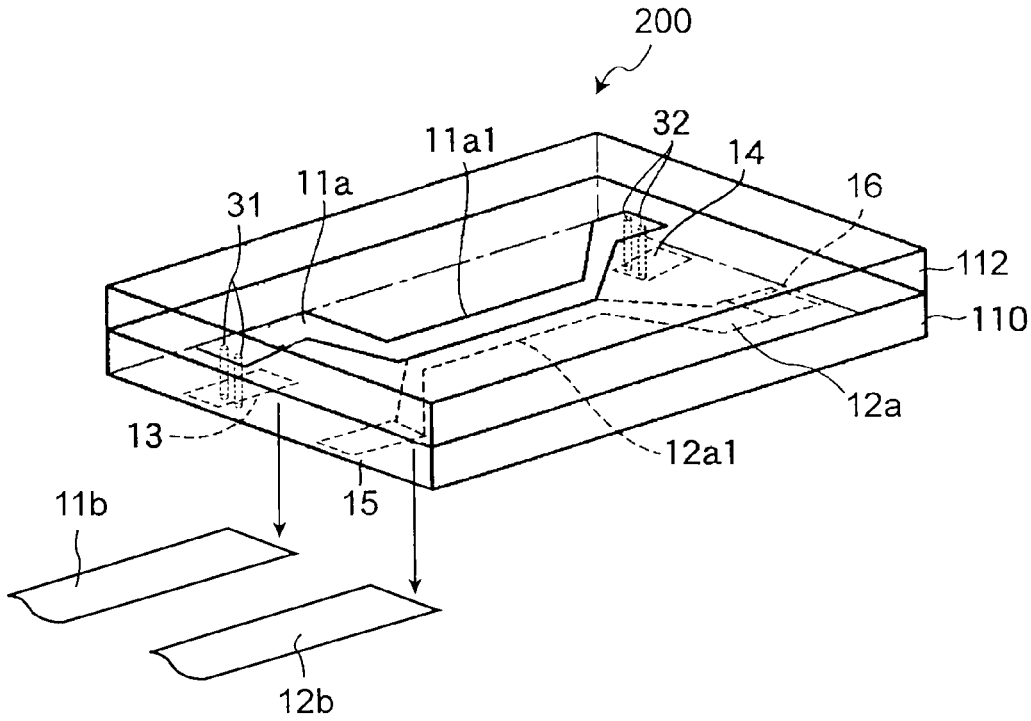
FIG. 3 is a perspective view of the main portion composition of the directional coupler according to the embodiment.
Figure 11:
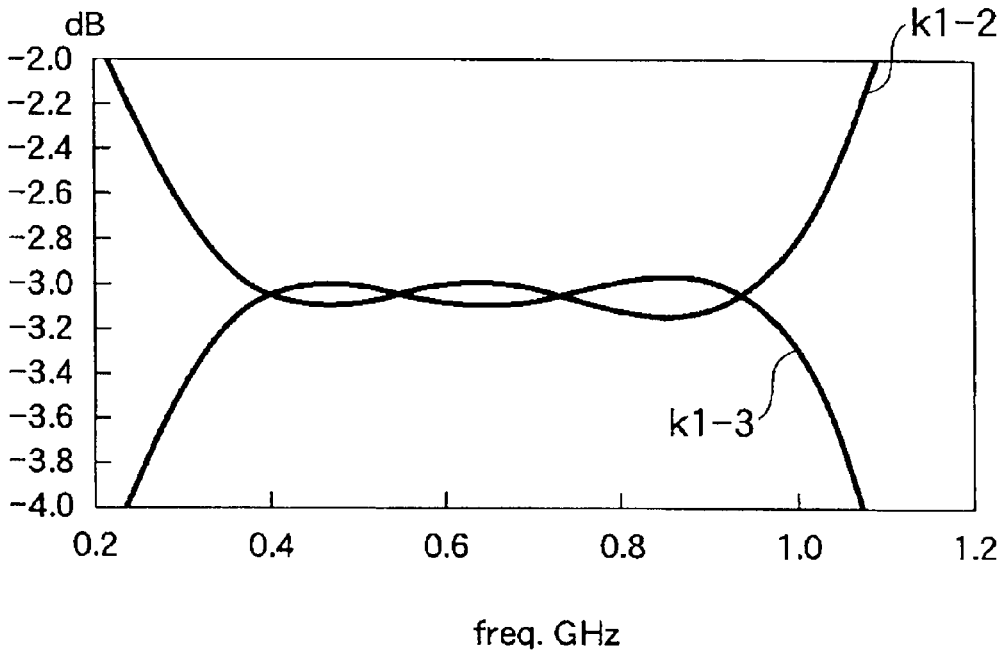
FIG. 11 PRIOR ART
FIG. 11 is a coupling characteristic diagram showing characteristic (5) of FIG. 6.
Figure 12:
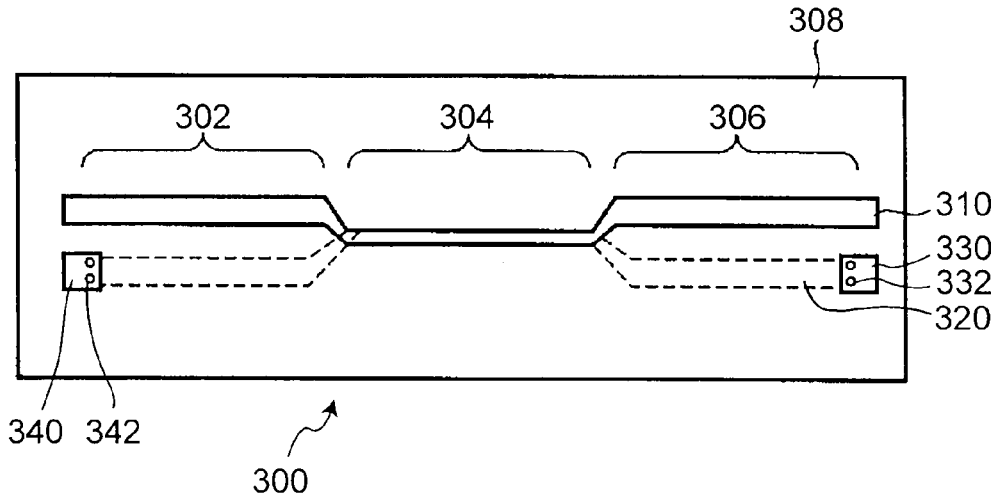
FIG. 12 is a drawing showing a directional coupler of an example considered conventionally.

With reference to FIG. 3, coupling substrate 200 will be explained in detail. Coupling substrate 200 uses printed circuit boards, each printed circuit board has a conductor layer. Coupling substrate 200 has base substance layer 110 which consists of dielectric and upper outer layer 112 which consists of dielectric. In FIG. 3, 11*b* and 12*b* denote transmission lines formed on substrate 100.

Transmission line 11*a* is formed on one principal surface (in FIG. 3, an upper surface) of base substance layer 110, and transmission line 12*a* is formed on another principal surface (in FIG. 3, an undersurface). Transmission lines 11*a* and 12*a* have overlapped parts 11*a*1 and 12*a*1 which are formed in parallel and overlap at center portions, respectively.

On the another principal surface of base substance layer 110, contact parts 13 and 14 are formed in positions which counter transmission line 11*b*. And contact parts 15 and 16 are formed in positions which counter transmission line 12*b*. Both ends of transmission line 11*a* are extended from overlapped part 11*a*1 to end portions of base substance layer 110 which counter contact parts 13 and 14. And both ends of transmission line 11*a* are connected with contact parts 13 and 14 via through holes 31 and 32 which penetrates base substance layer 110 in the perpendicular direction. Both ends of transmission line 12*a* are extended from overlapped part 12*a*1 to end portions of base substance layer 110 to connect with contact parts 15 and 16.

Upper outer layer 112 is formed on base substance layer 110.

On an outside surface of outer layer 112, a conductor (not shown) is provided and this conductor is grounded.

Figure 4:
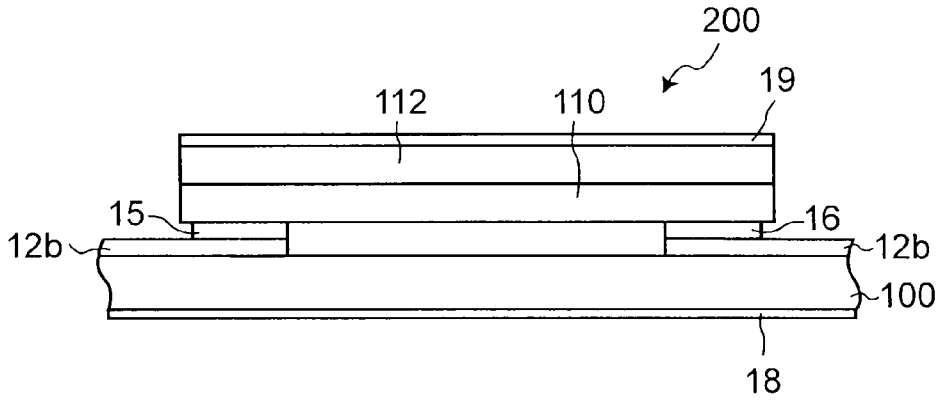
FIG. 4 is a side view of the main portion composition of the directional coupler according to the embodiment.

Substrate 200 is attached to the upper surface of substrate 100, which is a surface on which transmission lines 11*b* and 12*b* are formed. As a side view is shown in FIG. 4, contact parts 13, 14 (not shown), 15 and 16 formed on the undersurface of coupling substrate 200 contact transmission lines 11*b* (not shown) and 12*b* formed on the upper surface of substrate 100, respectively. In addition, in FIG. 4, 18 denotes the conductor formed on the back surface of substrate 100, and 19 denotes the conductor formed on upper outer layer 112.

Furthermore, in FIG. 4, transmission lines 11*a* and 12*a* are omitted.

Contacting portions between transmission lines 11*b* and 12*b* and contact parts 13, 14, 15 and 16 are soldered. Thereby, coupling substrate 200 is attached to substrate 100, and coupling part 22 is connected with coupling parts 21 and 23 in series.

Next, a directional coupler in which a degree of coupling was designed at 3 dB will be explained with reference to FIG. 5 through FIG. 11.

Figures 5, 6:
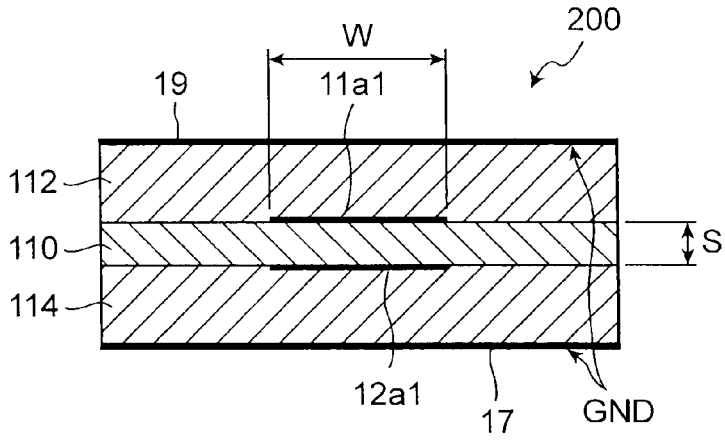
FIG. 5 is a sectional view of a coupling substrate.
FIG. 6 is a table explaining each size and characteristic of the coupling substrate shown in FIG. 5.

In a design of this directional coupler, coupling substrate 200 is considered to have a structure shown in FIG. 5. It is suppose that pattern width W and pattern gap S are 0.46 mm and 0.1 mm, respectively as a designed value.

FIG. 5 shows a cross sectional view of coupling substrate 200. Overlapped parts 11*a*1 and 12*a*1 of transmission lines 11*a* and 12*a* are provided on both surfaces of base substance layer 110 which consists of dielectric. Upper outer layer 112 is formed on one principal surface of base substance layer 110. Conductor 19 is formed on an outer surface of upper outer layer 112 and conductor 19 is grounded. On another principal surface of base substance layer 110, lower outer layer 114 which consists of dielectric is formed. Conductor 17 is formed in an outer surface of lower outer layer 114 and conductor 17 is grounded. In addition, unlike coupling substrate 200 shown in FIG. 2 through FIG. 4, coupling substrate 200 shown in FIG. 5 has lower outer layer 114.

In this design structure, each of pattern width W and pattern gap S of overlapped part 11*a*1 and 12*a*1 is variously changed, as shown in FIG. 6. Coupling substrate 200 with each size of FIG. 6 is used as coupling part 22, and coupling substrate 200 is connected to substrate 100 shown in FIG. 2 and directional couplers will be manufactured. The coupling characteristics of these directional couplers are calculated, respectively. When passband characteristic K1-2 of port 2 to an input to port 1 and passband characteristic K1-3 of port 3 to the input to port 1 are calculated, they become characteristics shown in FIG. 7 through FIG. 11.

Figure 7:
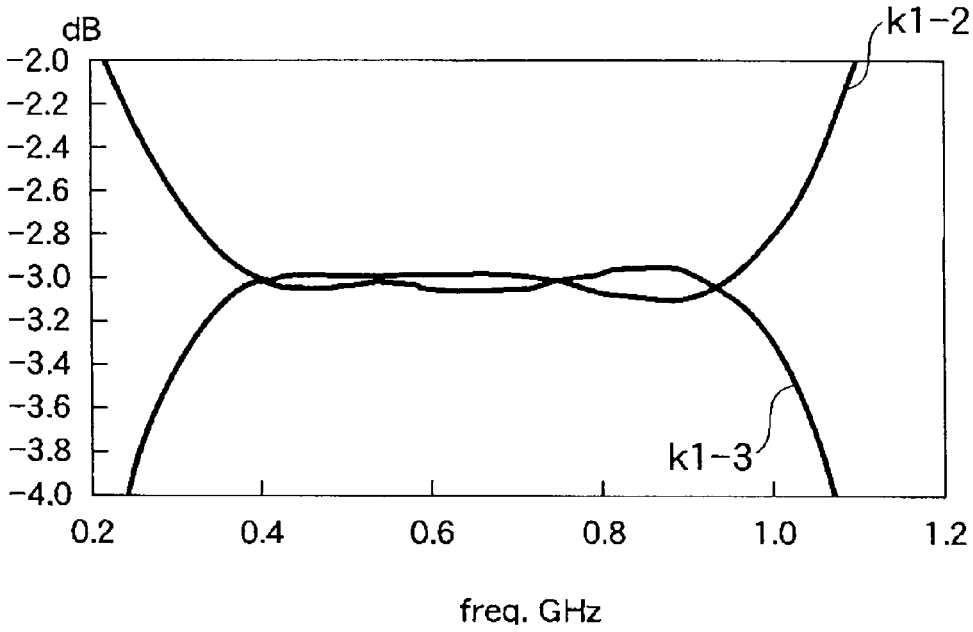
FIG. 7 is a coupling characteristic diagram showing characteristic (1) of FIG. 6.

FIG. 7 shows characteristic (1) by the designed value (pattern gap S is 0.1 mm and pattern width W is 0.46 mm). Each of passband characteristic K1-2 and passband characteristic K1-3 is 3 dB in a wide band and is very small in deviation.

Figure 8:
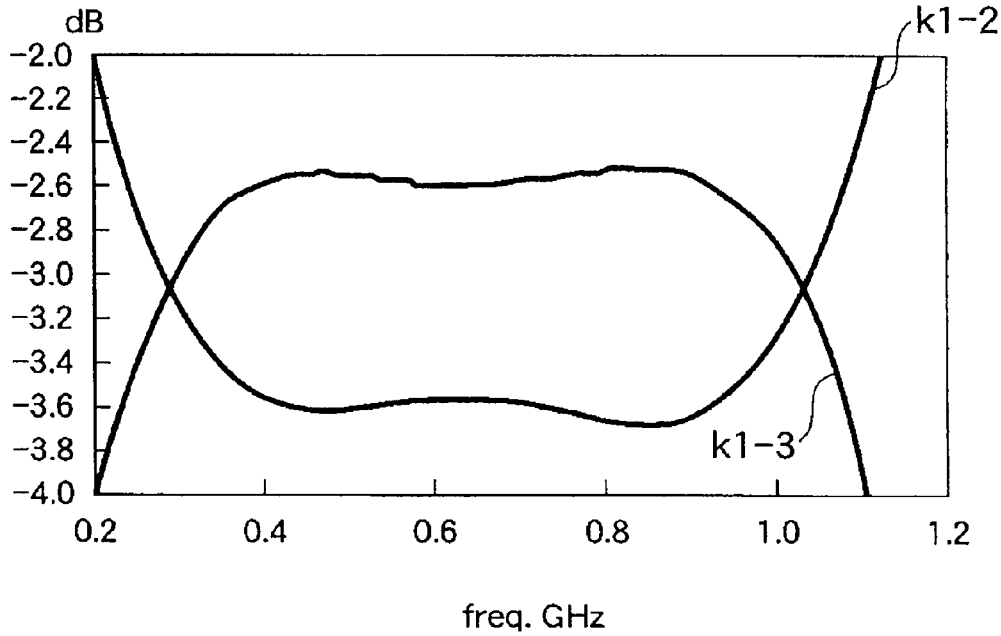
FIG. 8 is a coupling characteristic diagram showing characteristic (2) of FIG. 6.
Figure 9:
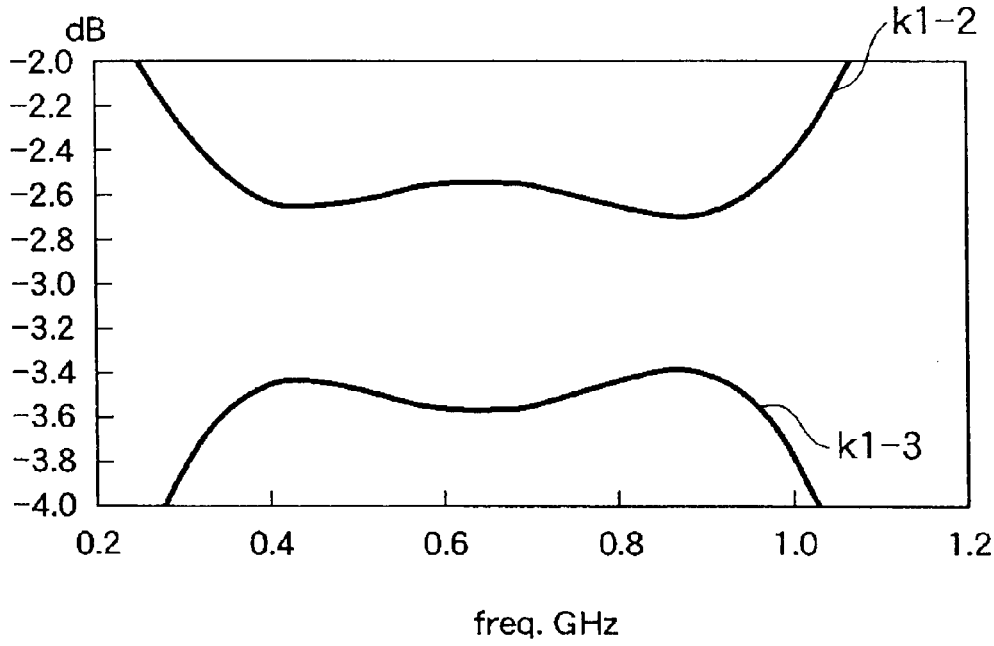
FIG. 9 is a coupling characteristic diagram showing characteristic (3) of FIG. 6.
Figure 10:
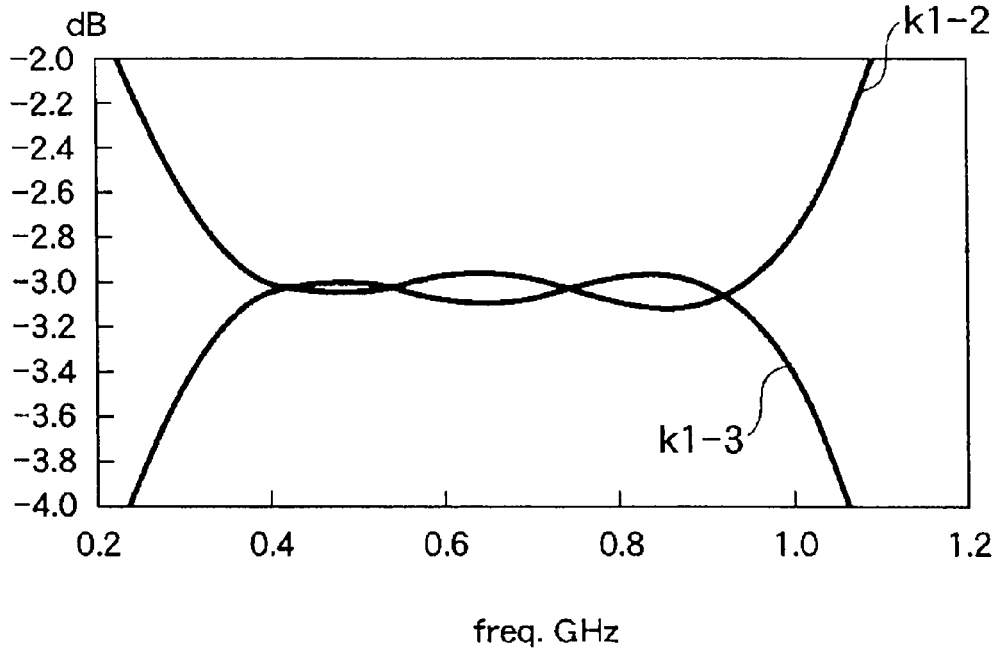
FIG. 10 is a coupling characteristic diagram showing characteristic (4) of FIG. 6.

FIG. 8 shows characteristic (2) and passband characteristic K1-2 and passband characteristic K1-3 are large in deviation. FIG. 9 shows characteristic (3) and passband characteristic K1-2 and passband characteristic K1-3 are large in deviation. FIG. 10 shows characteristic (4) and passband characteristic K1-2 and passband characteristic K1-3 are small in deviation. And FIG. 11 shows characteristic (5) and passband characteristic K1-2 and passband characteristic K1-3 are small in deviation.

Actual substrate 200 is usually manufactured based on pattern gap S and pattern width W of the above-mentioned designed value. But, substrate 200 cannot necessarily be manufactured as the designed value because of errors, such as a size of base substance layer 100 of dielectric.

In actual manufacturing, when pattern gap S becomes 0.08 mm owing to the size error of base substance layer 110, two coupling substrates 200 with pattern width W of 0.46 mm and 0.33 mm were manufactured. These coupling substrates 200 were applied to substrate 100 shown in FIG. 2 to manufacture directional couplers 10. And the coupling characteristic of each directional coupler 10 manufactured was measured.

By directional coupler 10 using coupling substrate 200 with pattern width W of 0.33 mm, a coupling characteristic similar to characteristic (4) by the calculated value shown in FIG. 10 was obtained. And, by directional coupler 10 using coupling substrate 200 with pattern width W of 0.33 mm, a coupling characteristic similar to characteristic (2) by the calculated value shown in FIG. 8 was obtained. In coupling characteristic shown in FIG. 8, the deviations of passband characteristic K1-2 and passband characteristic K1-3 are large. In coupling characteristic shown in FIG. 10, the deviations of passband characteristic K1-2 and passband characteristic K1-3 are small. A comparison with FIG. 7 shows that characteristic shown in FIG. 10 is close to the designed value. Therefore, coupling substrate 200 with pattern width W of 0.33 mm was chosen in this case, and directional coupler 10 was manufactured.

In actual manufacturing, when pattern gap S becomes 0.12 mm, two substrates 200 with pattern width W of 0.46 mm and 0.65 mm were manufactured as shown in FIG. 6. These coupling substrates 200 were applied to substrate 100 shown in FIG. 2 to manufacture directional couplers 10. And the coupling characteristics of directional couplers 10 manufactured were measured. By directional coupler 10 using coupling substrate 200 with pattern width w of 0.46 mm, a coupling characteristic similar to characteristic (3) by the calculated value shown in FIG. 9 was obtained. By directional coupler 10 using coupling substrate 200 with pattern width W of 0.65 mm, a coupling characteristic similar to characteristic (5) by the calculated value shown in FIG. 11 was obtained. In coupling characteristic shown in FIG. 9, the deviations of passband characteristic K1-2 and passband characteristic K1-3 are large. In coupling characteristic shown in FIG. 11, the deviations of passband characteristic K1-2 and passband characteristic K1-3 are small. A comparison with FIG. 7 shows that characteristics shown in FIG. 11 are close to the designed value. Therefore, coupling substrate 200 with pattern width W of 0.65 mm was chosen in this case, and directional coupler 10 was manufactured.

In addition, as for the above-mentioned coupling substrate 200 referred to FIG. 5, lower outer layer 114 and conductor 17 are formed. But, these are not necessarily required and substrate 100 and conductor 18 are formed instead of them in the embodiment shown in FIG. 2 through FIG. 4.

As mentioned above, according to the directional coupler of this embodiment, coupling part 22 among three stages of coupling parts 21, 22 and 23 is formed in coupling substrate 200 which is different from substrate 100. And coupling substrate 200 is attached to substrate 100. When adjusting the degree of coupling to become wideband, it was required to repair substrate 100 itself conventionally. However, in the case of this embodiment, what is necessary is just to choose optimal coupling substrate 200 from coupling substrates 200 of different pattern width W and pattern gap S and to exchange coupling substrate 200 with optimal coupling substrate 200. It is not necessary to modify substrate 100 itself at all.

Therefore, according to the directional coupler of the embodiment of the present invention, the degree of coupling can be adjusted easily and comparatively by low cost.

In addition, the above-mentioned embodiment explained the example of directional coupler 10 which has coupling parts 21, 22 and 23 of 3-stage constitution. Directional coupler 10 which has more stages of coupling parts is feasible similarly. Coupling substrate 200 having the coupling part is not restricted to one and plural coupling substrates 200 may be attached to substrate 100. In addition, in the present invention, it is desirable to form in coupling substrate 200 the coupling part whose degree of coupling is deeper than other coupling part and in which a manufacturing error tends to occur.

According to the directional coupler of the present invention, even when a directional coupler has only one stage of coupling part 22, coupling part 22 may be formed in coupling substrate 200 and ports 1, 2, 3 and 4 may be formed in substrate 100.

Furthermore, the above-mentioned embodiment explained the example which uses the printed circuit board for coupling substrate 200. However, other substrates may be used.

In the above-mentioned embodiment, transmission lines 11*b* and 12*b* which form coupling parts 21 and 23 are formed on the same surface of substrate 100. However, transmission line 11*b* and transmission line 12*b* may be formed on different surfaces of substrate 100, respectively. That is, contact parts of transmission lines 11*b* and 12*b*, to which coupling part 22 of coupling substrate 200 is attached, should just be formed on one surface of substrate 100. For example, contact parts of transmission line 11*b* or 12*b* should just be drawn to one surface of substrate 100 via through holes formed in substrate 100 at the contacting portions between coupling part 22 of coupling substrate 200 and transmission lines 11*b* and 12*b*.

Other embodiments or modifications of the present invention will be apparent to those skilled in the art from consideration of the specification and practice of the invention disclosed herein. It is intended that the specification and example embodiments be considered as exemplary only, with a true scope and spirit of the invention being indicated by the following.

What is claimed is:

1. A directional coupler comprising: a first substrate including a first principal surface and a second principal surface that counters said first principal surface; a first transmission line formed on said first principal surface of said first substrate; a second transmission line formed on said first principal surface of said first substrate; and a coupling substrate including a third transmission line and a fourth transmission line forming a first coupling part, said coupling substrate being attached to said first substrate so that said first coupling part is inserted in said first transmission line and said second transmission line wherein said coupling substrate includes a first base layer having a third principal surface and a fourth principal surface that counters said third principal surface, said third transmission line is formed on said third principal surface of said first base layer, said fourth transmission line is formed on said fourth principal surface of said first base layer, and said coupling substrate is attached to said first principal surface of said first substrate so that said third principal surface of said first base layer counters said first principal surface of said first substrate wherein said first transmission line and said second transmission line have a region in which said first transmission line and said second transmission line are close and are parallel and said first transmission line and said second transmission line form a second coupling part at said region.

2. The directional coupler according to claim 1, wherein said third transmission line is inserted in said first transmission line and said fourth transmission line is inserted in said second transmission line.

3. The directional coupler according to claim 1, wherein said coupling substrate includes a printed circuit board on which a conductor layer is formed.

4. The directional coupler according to claim 1, wherein said coupling substrate includes; through holes which are formed in said first base layer at both ends of said fourth transmission line and which draw said fourth transmission line to said third principal surface, and said third transmission line is connected to said first transmission line, and said fourth transmission line is connected to said second transmission line via said through holes.

5. The directional coupler according to claim 1, wherein said first coupling part is formed by an overlapped part to which said third transmission line overlaps with said fourth transmission line.

6. The directional coupler according to claim 4, further comprising:

a first conductor formed on said second principal surface of said first substrate;

a second base layer provided on said first base layer; and a second conductor formed on said second base layer.

7. The directional coupler according to claim 1, wherein said first transmission line and said second transmission line have a second region in which said first transmission line and said second transmission line are close and are parallel, and said first transmission line and said second transmission line form a second coupling part and a third coupling part at said second region.

8. The directional coupler according to claim 1, wherein both ends of said first transmission line and both ends of said second transmission line are connected to ports, respectively.

9. The directional coupler according to claim 1, wherein a degree of coupling of said first coupling part is deeper than that of said second coupling part.

10. A directional coupler comprising: a first substrate including a first principal surface and a second principal surface that counters said first principal surface; a first transmission line formed on said first principal surface of said first substrate; a second transmission line formed on said first principal surface of said first substrate; and coupling parts of m (m is natural number) stages connected in series and inserted in said first transmission line and said second transmission line; wherein at least one of said coupling parts of m stages is formed in a coupling substrate which includes: a first base layer having a third principal surface and a fourth principal surface that counters a third principal surface; a third transmission line formed on said third principal surface of said first base layer; and a fourth transmission line formed on said fourth principal surface of said first base layer; and said coupling substrate is attached to said first principal surface of said first substrate so that said third principal surface of said first base layer counters said first principal surface of said first substrate wherein said first transmission line and said second transmission line have a region in which said first transmission line and said second transmission line are close and are parallel and said first transmission line and said second transmission line form a second coupling part at said region.

11. The directional coupler according to claim 10, wherein said coupling substrate includes a printed circuit board on which a conductor layer is formed.

12. The directional coupler according to claim 10, wherein said third transmission line is inserted in said first transmission line and said fourth transmission line is inserted in said second transmission line.

13. The directional coupler according to claim 10, wherein said coupling substrate further includes:

through holes which are formed in said first base layer at both ends of said fourth transmission line and which draw said fourth transmission line to said third principal surface, and said third transmission line is connected to said first transmission line, and said fourth transmission line is connected to said second transmission line via said through holes.

14. The directional coupler according to claim 10, wherein both ends of said first transmission line and both ends of said second transmission line are connected to ports, respectively.

* * * * *